US010950101B2

(12) United States Patent
Falkenberg et al.

(10) Patent No.: US 10,950,101 B2
(45) Date of Patent: Mar. 16, 2021

(54) THEFT-PREVENTION SYSTEM AND METHOD WITH MAGNETIC FIELD DETECTION

(71) Applicant: ALERT SYSTEMS APS, Hørsholm (DK)

(72) Inventors: Verner Falkenberg, Copenhagen (DK); Dennis Pedersen, Åbyhøj (DK)

(73) Assignee: Alert Systems ApS, Horsholm (DK)

( * ) Notice: Subject to any disclaimer, the term of this patent is extended or adjusted under 35 U.S.C. 154(b) by 0 days.

(21) Appl. No.: 16/754,896

(22) PCT Filed: Oct. 5, 2018

(86) PCT No.: PCT/EP2018/077148
§ 371 (c)(1),
(2) Date: Apr. 9, 2020

(87) PCT Pub. No.: WO2019/072716
PCT Pub. Date: Apr. 18, 2019

(65) Prior Publication Data

US 2020/0294374 A1 Sep. 17, 2020

(30) Foreign Application Priority Data

Oct. 10, 2017 (DK) ..... PA 2017 70770

(51) Int. Cl.
*G08B 13/14* (2006.01)
*G08B 13/24* (2006.01)
(Continued)

(52) U.S. Cl.
CPC ..... *G08B 13/149* (2013.01); *G08B 13/2442* (2013.01); *G08B 13/26* (2013.01); *G08B 29/04* (2013.01); *G08B 29/185* (2013.01)

(58) Field of Classification Search
CPC ..... G08B 13/24
See application file for complete search history.

(56) References Cited

U.S. PATENT DOCUMENTS 3,971,983 A 7/1976 Jaquet
4,063,230 A 12/1977 Purinton et al.
(Continued)

FOREIGN PATENT DOCUMENTS

EP 2 997 557 B1 6/2017
JP S 55-151285 A 11/1980
WO WO 2014/184192 A1 11/2014

OTHER PUBLICATIONS

Search Report from Danish Patent and Trademark Office for corresponding Danish Appln. No. PA 2017 70770, dated Apr. 15, 2018, 2 pages.
(Continued)

*Primary Examiner* — Nabil H Syed
*Assistant Examiner* — Cal J Eustaquio
(74) *Attorney, Agent, or Firm* — Brinks Gilson & Lione; John C. Freeman

(57) ABSTRACT

An electronic theft-alerting system, including magnetometers, such as multiaxis magnetometers, arranged in respective stations and configured to output respective vector signals representing movement of respective magnetic field vectors; and a signal processor coupled to receive the first and second vector signals, and configured to detect a corresponding movement of a first magnetic field vector and a second magnetic field vector. Detecting commencement and continuance of fluctuation the first magnetic field vector, determining whether to raise or forgo to raise an alarm that warns about a possible theft-related event in response to the determining of commencement and continuance of fluctuation of the first magnetic field vector or the second magnetic field vector.

17 Claims, 5 Drawing Sheets

(51) Int. Cl.

| | |
|---|---|
| ***G08B 13/26*** | (2006.01) |
| ***G08B 29/04*** | (2006.01) |
| ***G08B 29/18*** | (2006.01) |

(56) References Cited

U.S. PATENT DOCUMENTS

| | | | |
|---|---|---|---|
| 6,310,549 | B1 | 10/2001 | Loftin et al. |
| 7,561,051 | B1 | 7/2009 | Kynor et al. |
| 2003/0071739 | A1 | 4/2003 | Addy et al. |
| 2007/0080806 | A1 | 4/2007 | Lax et al. |
| 2010/0295543 | A1 | 11/2010 | Miska et al. |
| 2011/0074581 | A1 | 3/2011 | Falkenberg et al. |
| 2016/0093183 | A1 | 3/2016 | Falkenberg et al. |
| 2016/0163166 | A1 | 6/2016 | Prunet et al. |

OTHER PUBLICATIONS

International Search Report dated Jan. 24, 2019 from corresponding PCT Appln. No. PCT/EP2018/077148, 2 pages.
Written Opinion dated Jan. 24, 2019 from corresponding PCT Appln. No. PCT/EP2018/077148, 2 pages.

THEFT-PREVENTION SYSTEM AND METHOD WITH MAGNETIC FIELD DETECTION

This application is a National Stage application of International Application No. PCT/EP2018/077148, filed Oct. 5, 2018, the entire contents of which are incorporated herein by reference.

This application claims priority under 35 U.S.C. § 119(a) to Danish Patent Application No. PA 2017 70770, filed on Oct. 10, 2017, the entire contents of each of which are incorporated herein by reference.

BACKGROUND OF THE INVENTION

Field of the Invention

Theft, also known as shoplifting, is a problem for many retailers—especially for those who sell those consumer goods such as apparel, clothes that are relatively easy to hide under a coat, in a handbag or the like—especially if fitting rooms are available.

Electronic article surveillance, EAS, is known in the art to prevent goods being removed from a shop or shopping area in an unauthorized way.

In accordance with conventional EAS systems, a salesperson attach an electromagnetic tag to the goods, e.g. to the more expensive ones of the goods. Antennas are placed near the entrance/exit(s) to/from the shop or shopping area and are coupled to an electric circuit that detects passing tags attached to goods. Normally the tags are removed when the goods are paid for at the cashier. So, when a passage of a tag between the antennas is detected it is usually a theft-related event.

Despite such systems being widely installed, in almost every store e.g. those selling clothes or even those selling foodstuff, theft is still a huge problem for the retailers.

It is realized that people who intends to perform theft enters the shop or shopping area with a magnet configured to unlock the lock that attaches the above-mentioned tag to the goods. Then, in the shop, they remove the tag from the goods and leave the tag behind. They then take the goods out of the shop without raising any alarm by conventional EAS alarm systems.

Such a magnet configured to unlock the lock that attaches the above-mentioned tag to the goods is denoted a detacher, a detacher magnet or unlock magnet. However, such a detacher magnet is easily confused with other magnetic objects present and even moving about in and around a shopping area. Magnets may be used in locks for bags and metal parts in e.g. shoes or bags may appear as magnets.

A problem is then that automatic detection easily generates either false alarms or doesn't detect a magnet when it should. In this respect it should be noted that false alarms are seriously disliked by the sales personnel and the customers who risk getting erroneously accused of theft.

RELATED PRIOR ART

US 2007/080806 describes a security system which includes a security tag operable for connection to merchandise to be secured, a monitoring device operable to monitor whether a party removes or attempts to remove the security tag from the merchandise and an alarm operable to emit a tamper alarm signal when the monitoring device indicates that a party has removed or attempted to remove the security tag from the merchandise in an unauthorized condition.

However, observations have shown that authorized detachers, such as magnet detachers, eventually ends up in the hands of persons using them to remove tags, but in an unauthorized way in connection with theft.

EP 2 997 557 B1 relates to automatically detect when a detacher magnet enters the shop or shopping area and describes an electronic theft-preventing system reliably giving an alarm when a strong magnet as used in a detacher enters a shopping area. The electronic theft-preventing system comprises a first and second multi-axis magnetometer arranged in a first and second station and configured to output a first and second vector signal representing movement of a first and second magnetic field vector, respectively; and a signal processor coupled to receive the first and second vector signals, and configured to: estimate a first rotation of the first magnetic field vector and a second rotation of the second magnetic field vector; generate an indicator signal comprising indication of a counter-direction rotation or a same-direction rotation; and determining whether to issue or inhibit an alarm signal that warns about a possible theft-related event in response to at least the indicator signal. The system warns if an unlock magnet for an anti-shoplifting tag pass between the stations e.g. when the stations are located at each respective side of an entrance to a shopping area. However, it is still desired to improve reliability in connection with detecting a theft related event.

SUMMARY

It has been observed that theft-related events, such as those comprising a person operating a detacher magnet to remove a tag associated with an electronic article surveillance system and attached to goods such as apparel items, are hard to detect in a reliable manner. In connection therewith it is a concern that regular, law-abiding customers may be bothered unnecessarily since this may have detrimental effects on the customer's shopping experience.

It is observed that a person operating a detacher magnet to remove a tag from goods such as apparel needs some time and usually repeated operations to succeed with the theft-related intention.

There is provided:

An electronic theft-preventing system, comprising:

- a first magnetometer arranged in a first station and configured to output a first vector signal representing movement of a first magnetic field vector;
- a second magnetometer arranged in a second station and configured to output a second vector signal representing movement of a second magnetic field vector; and
- a signal processor coupled to receive the first and second vector signals, and configured to:
  - detect a corresponding movement of the first magnetic field vector and the second magnetic field vector;
  - subsequent to the detecting of a corresponding movement of the magnetic field vectors, detecting commencement and continuance of fluctuation of at least the first magnetic field vector or the second magnetic field vector; wherein continuance of the fluctuation is determined in accordance with a first timing criterion;
  - determining whether to raise or forgo to raise a first alarm that warns about a possible theft-related event in response to at least the determining of commencement and continuance of fluctuation of at least the first magnetic field vector or the second magnetic field vector.

Thereby, problems related to how to more reliably detect a theft-related event involving using a magnet-based tag detacher can be solved.

Detection of the corresponding movement of the first magnetic field vector and the second magnetic field vector enables detection of the scenario that the detacher magnet is carried along a movement path by a person entering a secluded area, at which the first station and the second station are installed. Then, when in the secluded area, commencement and continuance of fluctuation of at least the first magnetic field vector or the second magnetic field vector may be determined as indication of theft-related event involving a person repeatedly operating the detacher magnet for some time to succeed with the theft-related intention.

A person with theft-related intentions may want to enter a secluded area such as a fitting room, usually in the form of a compartment with a curtain or door since it takes some time and usually repeated operations to succeed with the unauthorized tag removal using a magnet-based tag detacher. Thus, advantageously, in some installations of the system, the first station and the second station are installed at respective sides of an entryway to secluded area, such as a 'fitting room' or 'dressing room' of a shopping area.

The electronic theft-preventing system provides detection of a magnet passing the first station and the second station e.g. in an inbound movement, between the first station and the second station, towards or into the secluded area.

Detection of corresponding movement of the first magnetic field vector and the second magnetic field vector may comprise determining whether the first magnetic field vector and the second magnetic field vector rotates about respective vertical axes intersecting the respective multi-axis magnetometers. Detection of corresponding movement of the first magnetic field vector and the second magnetic field vector may comprise detecting counter movements of the first magnetic field vector and the second magnetic field vector about their respective vertical axes. Such a counter movement may represent a movement between the first station and the second station e.g. an inbound movement.

In some aspects, performing one or both of detecting the commencement and continuance of fluctuation of at least the first magnetic field vector or the second magnetic field vector and determining whether to raise or forgo to raise a first alarm depends on a positive outcome of the detecting a corresponding movement of the first magnetic field vector and the second magnetic field vector. Thereby, movement, e.g. by the detacher magnet entering into the secluded area, is a condition for raising an alarm.

In some aspects one or both of the first magnetometer and the second magnetometer are multi-axis magnetometer(s). The magnetometers may have one or more axes for sensing magnetic field vectors.

The multi-axis magnetometers can be e.g. of the magnetoresistive type. It may an integrated unit of two or three axes type or it may be in the form of one, two or three single axis magnetometers. The vector signals output from the multi-axis magnetometers comprise a signal component from each axis either in analogue or digital form. A two-axis magnetometer gives a two-dimensional vector signal and a three-axis, a three-dimensional vector signal. The signal components of a vector signal are output in parallel or in multiplexed form. Each signal component corresponds to a respective dimension of the vector signal.

The vector signal represents movement over time of a magnetic field vector and depends on the magnetic signal sensed by the magnetometer. The magnetic vector moves in a vector space and its rotation can be estimated (computed) with respect to its dimensions. There are various methods available in the field of vector mathematics to compute the rotation.

In some embodiments detection of a corresponding movement of the first magnetic field vector and the second magnetic field vector comprises:

determining whether movement of the first magnetic field vector and the second magnetic field vector correspond to a substantially horizontal movement of a magnet between the first station and the second station.

In some aspects, the determination of whether the first magnetic field vector and the second magnetic field vector represent movement of a magnet between the first station and the second station is in accordance with evaluation of one or both of a length and an rotation of the magnetic field vectors.

In some aspects, the corresponding movement of the first magnetic field vector and the second magnetic field vector is detected in accordance with an alternative or additional criterion of a concurrent movement of the magnetic field vectors. In some aspects, during the concurrent movement of the magnetic field vectors, the field vectors may have different length (strength) e.g. a first magnetic field vector from a right hand side station may be longer (stronger) than a second magnetic field vector from a left hand side station in case a detacher-magnet passes closer to the right hand side station than the left hand side station.

In some embodiments detecting continuance of fluctuation comprises:

determining whether movement of one or both of the first magnetic field vector and the second magnetic field vector correspond to an oscillating movement of a magnet in proximity of one or both of the first station or in proximity of the second station.

In some embodiments one or more of the magnetometers are configured to measure magnetic field vectors in three dimensions and the signal processor is configured to:

at multiple points in time, determining whether movement of the first magnetic field vector and the second magnetic field vector correspond to a substantially horizontal movement of a magnet between the first station and the second station; and in accordance therewith, raising a first alert;

in accordance with a determination that movement of one or both of the first magnetic field vector and the second magnetic field vector corresponds to an oscillating movement of a magnet in proximity of one or both of the first station or in proximity of the second station, raising a second alert;

wherein the determining whether to raise or forgo to raise a first alarm that warns about a possible theft-related event is in accordance with evaluation of the first alert and the second alert.

Thereby, the first alert may represent that a detacher magnet enters, e.g. by being carried in a bag or in a pocket, between the stations and into a dressing room. The second alert may represent that a detacher magnet is moved e.g. in a repeated way causing a fluctuation predominantly in a vertical plane (about a horizontal axis).

In some aspects the determining whether to raise or forgo to raise a first alarm that warns about a possible theft-related event may be based on the criteria that the second alert occurs at a point in time succeeding a point of time of the first alert. One or both of the first alert and the second alert may be reset in accordance with a timing criterion e.g. that the second alert didn't occur within a time period running from the point of time of the first alert.

The determination whether movement of the first magnetic field vector and the second magnetic field vector predominantly occur as a movement in a vertical plane or as a movement in a horizontal plane, may begin in accordance with a determination that one or more of the magnetic field vectors exceed a criterion e.g. an amplitude criterion i.e. that the vectors exceed a threshold length e.g. over a predetermined period of time.

In some embodiments the signal processor is configured to:

perform detecting of commencement and continuance of fluctuation of at least the first magnetic field vector or the second magnetic field vector by an iterative process of:

detecting a pulse in one or both of the first vector signal and the second vector signal and in response thereto increasing a counter and starting a first timer; and in response thereto:

determining whether the first timer has reached a first timeout time; and in the affirmative event thereof, decreasing the counter; and determining whether the first counter has reached a first counter threshold; and in the affirmative event thereof, enabling the first alarm.

Thereby the first timing criterion is provided to discount for the case of no alternation or fluctuation of one or both of the magnetic field vectors over a period of time exceeding the timeout time. This further improves reliability of alarms raised by the electronic theft-preventing system.

The counter threshold represents the number of pulses that must be detected before the first alarm is enabled. The counter threshold is set such that when a succession of a predefined number of pulses has been detected, the counter reaches the counter threshold. As an exception, if the timer reaches the timeout time between two successive pulses in the succession of pulses, the counter needs more than the predefined number of pulses to reach the counter threshold.

In some aspects, detecting a pulse is based on one or more criteria of: the pulse exceeding a predefined magnitude threshold, exceeding slope steepness threshold, changing polarity, and changing slope polarity.

The determining of whether to raise or forgo to raise the first alarm that warns about a possible theft-related event is dependent on the first alarm being enabled. In the non-affirmative event that the counter fails to reach the counter threshold, the first alarm is not enabled. The first alarm may be set to a default of being not enabled. The default may apply as a result of a power-on of the system and/or as a result of a reset such as a reset after an alarm has been raised.

In some embodiments the signal processor is further configured to:

determine whether the first counter has reached a termination counter value;

terminate the iterative process if the first counter has reached the termination counter value; and then reverting to detecting a corresponding movement of the first magnetic field vector and the second magnetic field vector.

Thereby magnetic fluctuations which occur sporadically with some pauses in between are less likely to cause an alarm. The system reverts to detecting a corresponding movement of the first magnetic field vector and the second magnetic field vector to enable the system to detect a magnet passing the first station and the second station e.g. in an inbound movement, between the first station and the second station, towards or into a secluded area, such as a fitting room.

In some embodiments the signal processor is further configured to:

in response to the first alarm being raised or enabled, detecting a fluctuation of at least the first magnetic field vector or the second magnetic field vector and starting a second timer;

determining whether the second timer has reached a second timeout time; and in the affirmative event thereof, resetting the first alarm;

in the non-affirmative event thereof, resetting the second timer.

Thereby, the alarm is reset in case continuance of the magnetic fluctuations stops being detectable, since the second timer has reached a second timeout time without being started upon detecting a post-alarm fluctuation. The case of the magnetic fluctuations stopped being detectable, may indicate that the person involved in the theft-related event has left the area. Hence, the person may not be reliably identifiable via his/hers presence in the area and detection of the theft-related event anymore.

Thus, the fluctuation of at least the first magnetic field vector or the second magnetic field vector being detected in response to the first alarm being raised or enabled is a post-alarm fluctuation.

In some aspects, resetting the first alarm comprises stopping the alarm e.g. from displaying or sounding an alarm signal.

In some aspects, resetting the second timer comprises forgo resetting the first alarm. Thereby the alarm is kept enabled for as long as a theft-related event is ongoing as sensed via the magnetic activity.

In some aspects, determining that the second timer has reached a second timeout time, causes the signal processor to revert to detecting a corresponding movement of the first magnetic field vector and the second magnetic field vector. Thus, an event of detecting that a magnet is passing the first station and the second station e.g. in an inbound movement, between the first station and the second station, towards or into a secluded area is required to enable the first alarm another time.

In some embodiments the electronic theft-prevention system comprises:

a third magnetometer arranged in a third station and configured to output a third vector signal; and wherein the signal processor is coupled to receive the third vector signal, and configured to:

detect a corresponding movement of the third and first magnetic field vector and/or the third and the second magnetic field vector;

subsequent to and in the affirmative event of the detecting of a corresponding movement of the magnetic field vectors, determining commencement and continuance of fluctuation of at least the third magnetic field vector; wherein continuance of the fluctuation is determined subject to a second timing criterion;

determining whether to raise or forgo to raise a second alarm that warns about a possible theft-related event in response to at least the determination of commencement and continuance of fluctuation of at least the third magnetic field vector, the first magnetic field vector or the second magnetic field vector.

The first alarm and the second alarm may then indicate at which location the possibly theft-related event is taking place. Thereby a person at the location may be caught red-handed; while the theft-related event is taking place. This is particularly important in shopping areas with multiple fitting rooms.

In some aspects the first alarm, mentioned above, is configured with a first location indicator indicating a first fitting room or area with an entrance located between the first station and the second station. The second alarm may be configured with a second location indicator indicating a second fitting room or area with an entrance located between the third station and the second station or between the third station and the first station.

In some aspects the third multi-axis magnetometer is a multi-axis magnetometer.

In some embodiments the signal processor is further configured to:

in response to determining that one or both of the third and the second magnetic field vector continues to fluctuate after one or both of the first and second magnetic field vectors has ceased to fluctuate, enabling the second alarm, while forgo enabling the first alarm;

in response to determining that one or both of the first and the second magnetic field vector continues to fluctuate after one or both of the third and the second magnetic field vectors has ceased to fluctuate, enabling the first alarm, while forgo enabling the second alarm.

Thereby reliability of the system may be improved in connection with neighbouring fitting rooms. In case of multiple, e.g. neighbouring fitting rooms, it may be hard to identify the fitting room wherein a possibly theft-related event is going on, especially if disturbing magnetic activity is going on in a neighbouring fitting room. However, it has been observed that the fitting room associated with respective stations yielding magnetic field vectors that keep fluctuating for the longest time is likely to be the fitting room wherein a possibly theft-related event is going on.

In some embodiments signal processor is further configured to:

in response to determining that one or both of the third and the second magnetic field vector is stronger than one or both of the first and second magnetic field vectors, enabling the second alarm, while forgo enabling the first alarm;

in response to determining that one or both of the first and the second magnetic field vector is stronger than one or both of the third and the second magnetic field vectors, enabling the first alarm, while forgo enabling the second alarm.

Thereby reliability of the system may be improved in connection with neighbouring fitting rooms. As mentioned above, it may be hard to identify one fitting room wherein a possibly theft-related event is going on amongst other fitting rooms. However, it has been observed that the fitting room associated with respective stations yielding the strongest magnetic field vectors is likely to be the fitting room wherein a possibly theft-related event is going on.

In some aspects enabling the first alarm, while forgo enabling the second alarm or vice versa is based on both relative strength of the magnetic field vectors as set out above and which one or more magnetic field vectors that continues to fluctuate after one or more other magnetic field vectors has ceased to fluctuate as set out above.

In some embodiments the signal processor is further configured to:

perform the detection of a corresponding movement of the first magnetic field vector and the second magnetic field vector by estimating a first rotation of the first magnetic field vector and a second rotation of the second magnetic field vector;

generating an indicator signal comprising indication of a counter-direction rotation or a same-direction rotation;

determining whether to enable the first alarm in response to at least the indicator signal.

Thereby it is possible to distinguish between inbound and outbound movements between two stations.

In some embodiments the first station and the second station are installed 0.5 to 1.5 meters above a floor level.

Is has been observed that when stations accommodating the magnetometers are installed 0.5 to 1.5 meters above a floor level an improved detectability of theft-related events is achieved and that improved ability to correctly identify the location, e.g. a particular fitting room, wherein a theft-related event is going on is achieved.

There is also provided a computer-implemented method of detecting a theft-related event, comprising:

acquiring first vector values representing movement of a first magnetic field vector by means of a first multi-axis magnetometer arranged in a first station;

acquiring second vector values representing movement of a second magnetic field vector by means of a second multi-axis magnetometer arranged in a second station;

detecting a corresponding movement of the first magnetic field vector and the second magnetic field vector;

subsequent to and in the affirmative event of the detecting of a corresponding movement of the magnetic field vectors, determining commencement and continuance of fluctuation of at least the first magnetic field vector or the second magnetic field vector; wherein continuance of the fluctuation is determined subject to a timing criterion; and determining whether to raise or forgo to raise an alarm that warns about a possible theft-related event in response to at least the determining commencement and continuance of fluctuation of at least the first magnetic field vector or the second magnetic field vector.

Embodiments and aspects of the signal processing described above in connection with the theft-prevention system constitutes embodiments and aspects of the computer-implemented method of detecting a theft-related event.

There is also provided a data processing system having stored thereon program code means adapted to cause the data processing system to perform the steps of the method according to the computer-implemented method, when said program codes means are executed on the data processing system.

There is also provided a computer program product comprising program code means adapted to cause a data processing system to perform the steps of the method according to the computer-implemented method, when said program code means are executed on the data processing system.

Here and in the following, the terms 'signal processor' is intended to comprise any circuit and/or device suitably adapted to perform the functions described herein. In particular, the above term comprises general purpose or proprietary programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

BRIEF DESCRIPTION OF THE FIGURES

A more detailed description follows below with reference to the drawing, in which.

DETAILED DESCRIPTION

Figure 1:
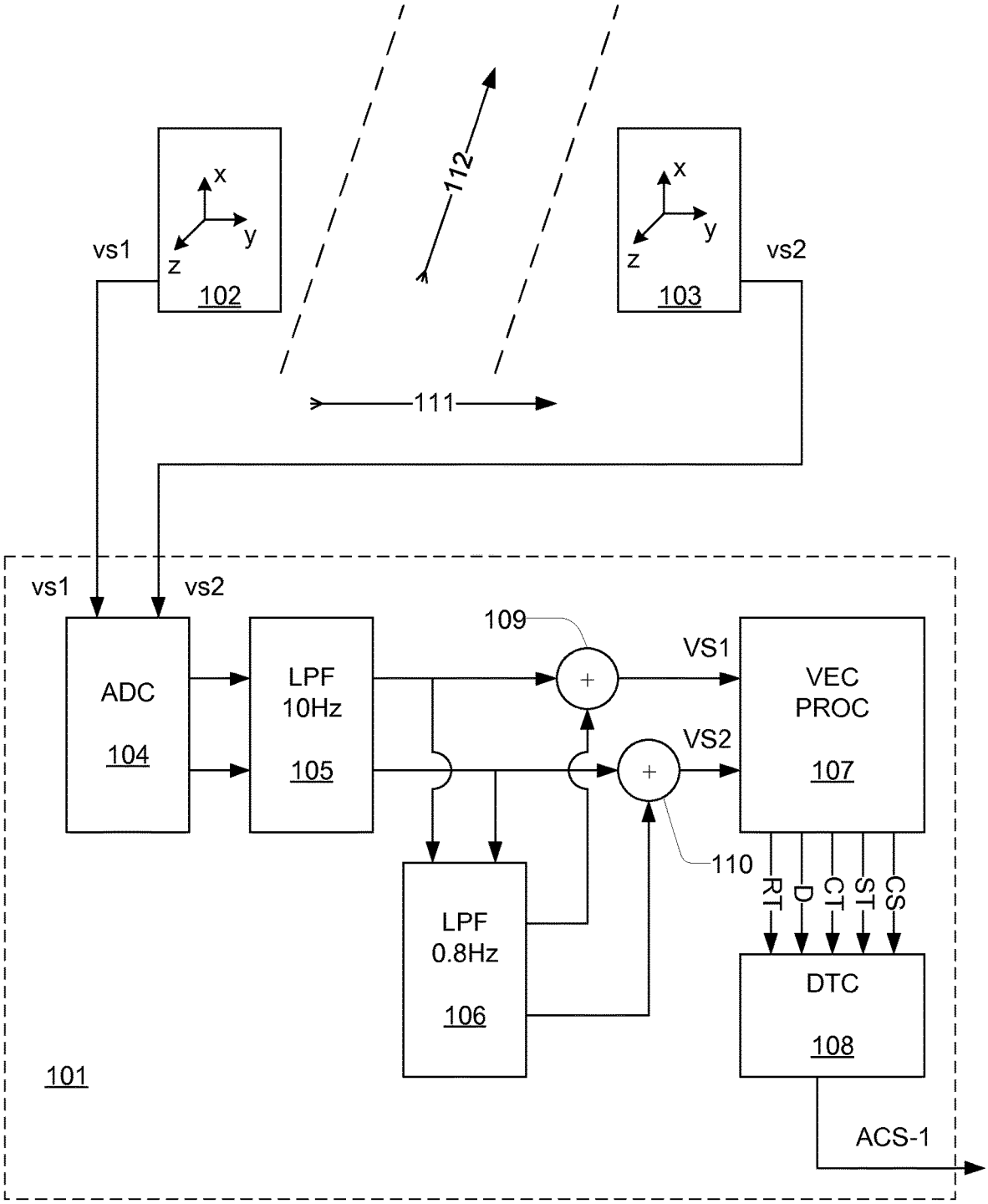
FIG. 1 shows a block diagram of a theft-preventing system with magnetometers.

FIG. 1 shows a block diagram of a theft-prevention system with multi-axis magnetometers. The multi-axis magnetometers are shown as three-axis magnetometers and are designated reference numerals 102 and 103 and outputs respective signals vs1 and vs2. The axes are designated x, y and z. In this embodiment the magnetometers are of the magneto-resistive type and output the signals vs1 and vs2 in analogue form. However, the magnetometers may be of other types, such as those outputting digital signals. Each of the magnetometers outputs an output signal with three dimensions e.g. as three parallel analogue signals or e.g. as three digital signals communicated on a serial digital bus. Such an output signal is denoted a vector signal; it has a signal component for each spatial dimension. The vector signal from a magnetometer represents the magnetic field sensed by the magnetometer. Conventional magnetometers may be arranged in a package with an indication of the orientation of the axes along which the magnetic field is sensed. Preferably the magnetometers 102 and 103 are arranged with their axes in parallel or substantially in parallel. Thereby signals from parallel axes of the respective magnetometers can more easily be compared and/or processed together.

In some embodiments the signals are output from the magnetometer as three multiplexed or parallel digital signals. The magnetometers may each have only one or two axes or more than three axes or one of them may have one or two axes whereas the other one has three axes. The magnetometers are arranged in a respective station located at each side, left and right, of an entrance way (illustrated by dashed lines) to an area, such as a fitting room.

A direction into the area and of passing between the respective stations is shown by arrow 112. A direction of passing by is shown by arrow 111. Thus a person entering the area will follow direction 112, whereas a person passing by will follow another direction 111.

In some embodiments, a station hosts one magnetometer, whereas in other embodiments a station hosts both a left and a right magnetometer for a respective entrance way. In some embodiments a single magnetometer serves both as a left and a right magnetometer. In some embodiments, when an alarm is raised, as described further below, it is raised with a visual designation or indication of the passage, among multiple passages e.g. to multiple fitting rooms, whereat an alarm triggering event occurred e.g. by displaying a number on a display.

Generally, herein the term 'raising an alarm' refers to act of causing the alarm to draw visual or audible attention to a possibly theft-related event. The term 'enabling to raise an alarm' refers to determining that an alarm may be raised, but that actually raising the alarm may be subject to other conditions.

The term station generally designates any housing or platform suitable for installing the magnetometer in a shopping area.

A signal processor is designated 101 and receives the signals vs1 and vs2 which are input to an analogue-to-digital converter, ADC, 104. The ADC may sample the signals at a relatively high sample rate e.g. 8 KHz which is decimated to a lower sample rate (not shown) as it is known in the art. Resulting digital signals are input to a low-pass filter, LPF, 105 with a cut-off frequency about 10 Hz or higher or lower. The cut-off frequency may be as low as about 4, 5 or 6 Hz and as high as 15, 20, 30 or 40 Hz. The output of the low-pass filter 105 is fed to the input of low-pass filter, 106 and in parallel therewith to respective adders 109 and 110 which subtracts the output from LPF, 106, from the output from LPF, 105.

LPF, 106 has a cut-off frequency about 0.8 Hz, but it can be lower say about 0.4 or 0.6 Hz and higher say about 1.0 or 1.6 Hz. LPF, 106, is configured to remove or diminish a substantially stationary portion of the vector signal attributed to the earth's magnetic field as sensed by the magnetometers. LPF 105 and LPF 106 implements in combination a band-pass filter suppress signal portions considered to move too fast or too slow to originate from movement in proximity of the magnetometers of magnets that could be used for theft-related activities. Thus, a band-pass implementation could be used as well.

The signals output from the adders 109 and 110 are designated VS1 and VS2, respectively. VS1 and VS2 are input to a vector processor, VEC PROC, 107. Thus the signals vs1 and vs2 are processed into to signals VS1 and VS2, respectively. This processing can be considered a pre-processing and is performed for six signal components when two three-axis magnetometers are used. Due to the relatively low sample rate, a general purpose signal processor is in general sufficiently fast to allow multiplexed or concurrent signal processing of the signal components.

The vector processor 107 performs the operations described in more detail below in connection with the flowcharts. The vector processor, 107, outputs one or more indicator signals, CS, RT and ST and/or CT and/or D, providing measures of magnetic field or electromagnetic field properties in proximity of the magnetometers. These measures are considered to correlate with theft-related events or non-theft related events, where the former can be used to enable an alarm signal and where the latter can be used to inhibit issuing an alarm.

A detector, DTC, 108, receives one or more of the signals CS, RT and ST and/or CT and/or D and determines whether to raise an alarm or enable an alarm to be raised or not. The detector outputs a first alarm control signal ACS-1. The alarm control signal, ACS-1 may be communicated to an alarm emitter (not shown) which emits an alarm by a visual and/or audible alarm signal to alert staff personnel. The alarm emitter may communicate the alarm to a mobile device, e.g. a so-called 'pager' carried by a staff person. An alarm emitter may comprise a control unit configured to determine under what conditions to raise an alarm. The control unit may receive multiple alarm control signals which respectively enable an alarm to be raised. The alarm control signals may be digital signals such as binary signals or analogue signals.

Figure 2:
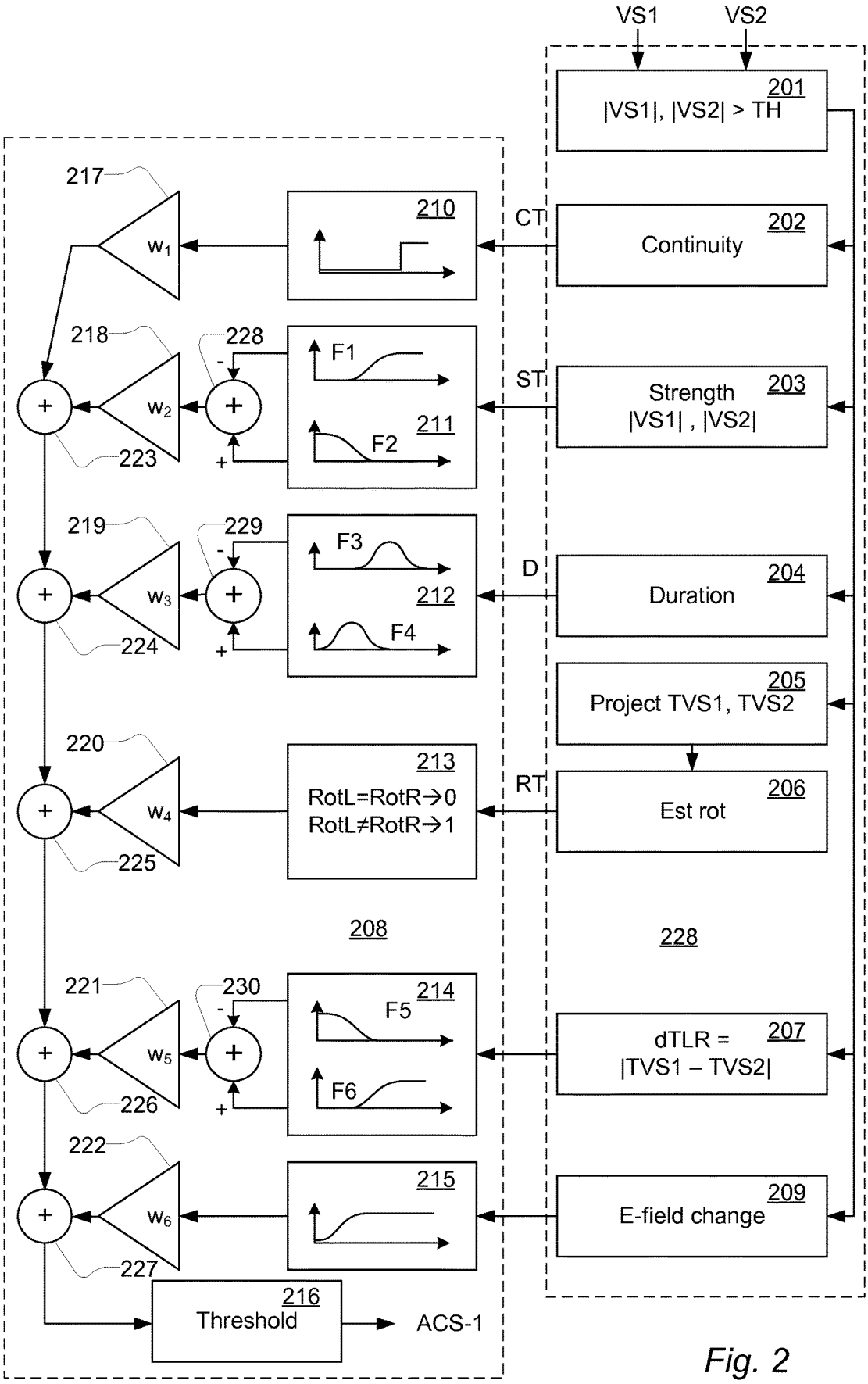
FIG. 2 shows a first flowchart for processing vector signals from magnetometers.

FIG. 2 shows a first flowchart for processing vector signals from magnetometers. The vector signals VS1 and VS2 are input to a first portion of the flowchart 228, which in some embodiments is performed by the vector signal processor 107. Another portion of the flowchart 208 is in some embodiments performed by the detector 108. However, other implementations can be used. In general 228 (107) and 208 (108) can be implemented by a single signal processor unit (e.g. in the form of a so-called integrated circuit signal processor). The processing of vector signals to determine whether a detacher magnet is passing between or passing along two magnetometers is also described in EP 2 997 557 B1 which is hereby referenced.

In step 201 the vector signals VS1 and VS2 are received sample-by-sample and the length |VS1| and |VS2| of the vector represented by the signal is computed. In case the length of one and/or both of them exceeds a threshold value TH processing may continue to the next step 202 and a so-called trace of vectors is started as a sequence of vectors. The trace ends when |VS1| and/or |VS2| fall below the threshold again. Processing may alternatively continue when a predefined number of samples exceeding the threshold are received or when a complete trace is recorded.

In the following step 202 continuity of the sequence of vectors is computed. A measure of continuity is computed to identify whether the vector rotates monotonically in the same direction over two or more samples. The measure of continuity can e.g. be computed as the so-called dot-product of any two consecutive vectors of the same signal VS1 or VS2. The measure is computed over a number of samples e.g. from a first to a next sample of from a first group of samples to a next group.

The number of samples over which continuity is found to be present is output as indicator signal CT. CT is then input to evaluation in step 210 which implements a mapping function. Below a predefined number of samples continuity is not present and a value of '0' is output, whereas above a predefined number of samples, continuity is present and a value of '1' is output. This mapping function is illustrated by the coordinate system in box 210, where the number of samples is represented along the abscissa axis and output values along the ordinate axis. Consequently, persistent continuity over more than a predefined number of samples is given a larger value than lack of or interruption of such continuity. This is reflected in the output, which is also designated an indicator signal, by step 210.

Output of step 210 is summed in a weighted manner by means of adders and weights, such as adder 223 and weight, w1, 217. The total sum computed by the adders 223, 224, 225, 226 and 227 is input to a threshold detector 216 which outputs a first alarm control signal, ACS-1, if the total sum exceeds a predefined threshold. The alarm control signal may be coupled to an alarm unit giving an audio and/or visual alarm signal. The alarm control signal may also be recorded in a log e.g. in a database for subsequent inspection.

The output provided by steps 202, 210 and 217 in respect of continuity gives a contribution to ACS indicating whether a magnetic object passed between the magnetometers or passed only halfway and then returned again. Computation of continuity may be aborted at the instant non-continuity is detected or a predefined number of samples thereafter. Computation of continuity may be resumed at any time including the instant when non-continuity is detected.

The strength of VS1 and VS2 is also provided as indicator signal ST, which may be computed or recalled in step 203, cf. the computation in step 201 above. The indicator signal ST is input to step 211 which also computes a mapping function with a value or values of ST as its input. This mapping function is illustrated by two coordinate systems F1 and F2 at the top and bottom of box 211. A large value of strength from ST gives a relatively large value from F1, whereas F2 outputs a lower value e.g. just above '0'. By means of adder 228 output from F1 is subtracted and output from F2 is added. The result of the addition performed by adder 228 is a value input to weight, w2, 218, and then input to adder 223. This value contributes to ACS as described above. Other ways of implementing the mapping function or an alternative mapping function are conceivable using conventional signal processing techniques.

The output provided by steps 203, 211, 228 and 218 in respect of strength gives a contribution to ACS indicating the strength of the object and may be used to distinguish e.g. unlock magnets from shopping carts of metal, where shopping carts of metal in general exhibits a stronger magnetic field around the cart. Therefore a large ST value drives the input to the threshold detector 216 to a smaller value to inhibit issuing an alarm. Vice versa; a weaker signal, but still above threshold TH (cf. step 201), drives the input to the threshold detector 216 to a greater value.

Further, a duration of the vector signal(s) during which it/they exhibits a sufficiently strength is estimated and used as an indicator signal, D. The duration may be estimated from a starting point when the signal strength exceeds a threshold level to an endpoint when the signal strength falls below the threshold level or another threshold level. Alternatively, the duration can be estimated as the time lag between two extreme values of a first or further derivative of the vector signal(s).

The indicator signal D is input to step 212 which also computes a mapping function with a value or values of D as its input. This mapping function is illustrated in two coordinate systems F3 and F4 at the top and bottom of box 212. A lower value of D gives a large value from F3 e.g. close to '1', whereas F4 outputs a lower value e.g. just above '0'. By means of adder 229 output from F3 is subtracted and output from F4 is added. The result of the addition performed by adder 229 is a value input to weight, w3, 219, and then input to adder 224. This value contributes to ACS as described above.

Thus, only if the value of duration is about a predefined, shorter duration, i.e. not too low or too high, the duration measure will drive issue of an alarm signal. If the duration is about a predefined, longer duration, the mapping function F3 results in a positive value e.g. '1' that is subtracted by adder 220 and thus drives the input to the threshold detector 216 to a smaller value to inhibit issuing an alarm. This may be the case when a shopping cart is present.

An estimate of the rotation of the vector signals computed and used as an indicator signal, RT. As mentioned above a trace of the vector signals VS1 and VS2 are acquired. The traces are respectively denoted TVS1 and TVS2. The traces comprise a respective sequence of samples of VS1 and VS2, where the strength of a vector sample (e.g. defined by its length) exceeds a threshold value (cf. step 201). In step 205 the traces are projected to a common two-dimensional plane. In the case where the magnetometers are aligned mutually with their axes in parallel or substantially in parallel, the projection reduces to using only two of the three dimensions of a vector sample. In preferred embodiments the traces are projected this way to three orthogonal planes. In step 206 the rotation of the magnetic field vectors, as defined by the traces, are estimated in each plane. So, for each plane two projections are made, one for each trace, TVS1 and TVS2. A method of estimating the rotation is given further below in connection with acquired traces.

As an alternative to projecting the traces to different planes which reduce the rotation estimation to one or more 2-dimensional estimations, 3-dimensional estimation methods or estimation methods other can be applied as well e.g. comprising estimating first a 2-dimensional plane in which or substantially in which a magnetic vector rotates and then estimating rotation in the estimated 2-dimensional plane.

Output from step 206 is a signal RT representing the rotation or rotation(s). In step 213 RT is converted into a binary signal with the value '0' if the rotation of TVS1 and TVS2 is in the same direction; and '1' if the rotation of TVS1 and TVS2 is a counter-direction rotation. However, other ways of encoding one or more output signals, RT, are conceivable. Thus, if a counter-direction situation occurs, e.g. if a magnet passes between the two magnetometers, a value '1' is output from step 213 to weight, w4, 220, which in turn outputs the weighted value to adder 225. This in turn drives the drives the input to the threshold detector 216 to a greater value to stimulate issuing an alarm.

Step 207 computes the length, dTLR, of the difference vector between TVS1 and TVS2, at sample instances.

The signal dTLR is also an indicator signal and is input to step 214 which computes a mapping function with a value or values of dTLR as its input.

This mapping function is illustrated in two coordinate systems F5 and F6 at the top and bottom of box 214. A lower value of dTLR gives a large value from F5 e.g. close to '1', whereas F6 outputs a lower value e.g. just above '0'. By means of adder 230, output from F5 is subtracted and output from F6 is added. The result of the addition performed by adder 230 is a value input to weight, w5, 221, and then input to adder 226. This value contributes to ACS as described above. More particular in the way that when a TVS1 vector and a TVS2 vector are substantially the same (substantially same direction and substantially same length), dTLR is short, the value of F5 dominates and due to the subtraction performed by adder 230, an alarm signal is inhibited. This event can occur when the sensed magnetic field is dominated by a strong, but relatively far removed object which should trigger an alarm. On the contrary, different directions of a vector in TVS1 and a vector in TVS2 indicate a proximate object which should trigger an alarm. Whether an alarm is triggered depends on the value(s) of the other indicator signals as described above.

Further, in step 209 a change in an electric field is measured. The hardware for measuring such a change is described further below. The output from step 209 is an indicator signal with the absolute value of a change in the strength of a magnetic field. Thus a drop or an increase in the amplitude of a magnetic field is represented by a larger value. The mapping function performed in step 215 gives a value close to '0' if the is no change and a value close to '1' if the is a change. Step 215 outputs a value to weight, w6, 222, according to its mapping function. The output from weight w6, 222, is then fed to adder 227 to stimulate or inhibit issuing an alarm.

In general, other ways of implementing the mapping function(s) are conceivable using conventional signal processing techniques. The functions chosen for the mapping functions may be chosen to suit implementation aspects, the computation of the measures, different numerical ranges etc. The weights and the mapping functions may also be tuned.

Thus, in case of detection of a corresponding movement of the first magnetic field vector and the second magnetic field vector, the first alarm control signal, ACS-1 is output to enable raising of an alarm.

Figure 3:
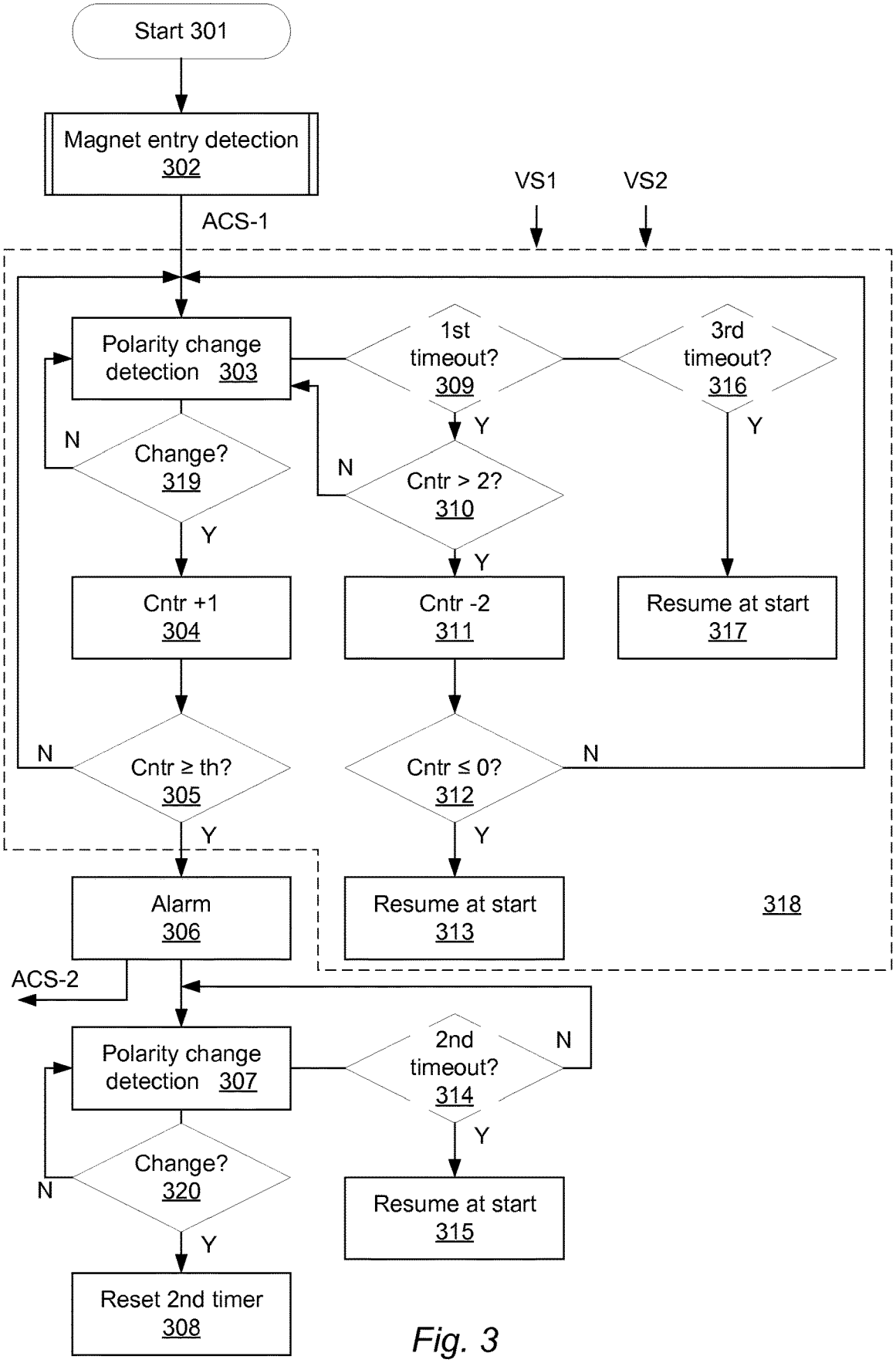
FIG. 3 shows a second flowchart for processing vector signals from magnetometers.

FIG. 3 shows a second flowchart for processing vector signals from magnetometers. The flowchart starts at step 301 in an idle state e.g. after power-on of the system. The system then proceeds to step 302, to detect a corresponding movement, if any, of the first magnetic field vector and the second magnetic field vector, e.g. as described above in connection with FIG. 2. In this way passage of a magnet between two stations can be detected. If a magnet entry is detected, e.g. as indicated by the first alarm control signal, ACS-1, the system proceeds to section 318 for detecting commencement and continuance of fluctuation of at least the first magnetic field vector or the second magnetic field vector as described below. If such commencement and continuance of fluctuation of at least the first magnetic field vector or the second magnetic field vector is determined, a second alarm control signal, ACS-2 is output. In one embodiment an alarm may thus be raised or enabled to be raised in case the first alarm control signal, ACS-1, and the second alarm control signal, ACS-2, are output.

At step 303 it is determined whether a change in polarity of the first magnetic field vector or the second magnetic field vector is detected, and if detected in step 319, a first counter is incremented, e.g. by 1, in step 304 in response thereto. Also, a first timeout timer is started. The first timeout timer lapses after a predefined time period of e.g. about 2 seconds.

Then, at step 305 the first counter is evaluated against a threshold value, th. If the first counter does not exceed the threshold value (N), processing resumes at step 303 to detect a further polarity change. If the first counter does exceeds the threshold value (Y), processing continues at step 306 wherein an alarm may be raised or enabled to be raised. Raising the alarm may be subject to additional conditions e.g. as explained further below.

In case a further polarity change is not detected before the first timeout timer lapses, as determined in step 309, processing continues at step 311 at which the first counter is decremented, e.g. by 2, subject to the condition that the first counter is greater than 2 as determined in step 310. If the first counter is not greater than 2, processing resumes at step 301 via step 317.

Subsequent to a decrement of the first timer at step 311, it is examined in step 312 whether the first counter is equal to less than 0. In the affirmative event (Y) thereof, processing resumes at step 301 via step 313. In the non-affirmative event (N) thereof, processing resumes at step 303 to detect a further polarity change.

Thus, as explained above continuance of fluctuation is determined in accordance with a timing criterion. Other ways of implementing a suitable timing criterion is foreseeable.

As mentioned above, processing may reach step 306 at which an alarm is raised or enable to be raised. At this point in time, a theft related event may be going on in a fitting room at the stations at which the magnetometers are installed. Thus, at this point it is determined whether to raise or forgo to raise a first alarm that warns about a possible theft-related event in response to at least the determining of commencement and continuance of fluctuation of at least the first magnetic field vector or the second magnetic field vector.

Upon an alarm being raised or enabled to be raised in step 306, and while the alarm is raised or enabled to be raised, processing continues at step 307 to determine polarity change detection in step 307 as described above. When a polarity change is detected, a second timeout timer is started in step 314. If a polarity change is detected in step 320, processing continues at step 308 wherein the second timer is reset. If a polarity change is not detected in step 320 before the second timeout timer lapses, processing resumes at start via step 315 if timeout is detected (Y) in step 314. In some embodiments the alarm is reset in step 315.

The alarm is thereby kept raised or enabled to be raised, as long as polarity changes occurs without timeout. This may indicate ongoing theft-related events in a fitting room. In some embodiments a timeout is used to prevent the system being caught in such a state for excessive time.

Figure 4:
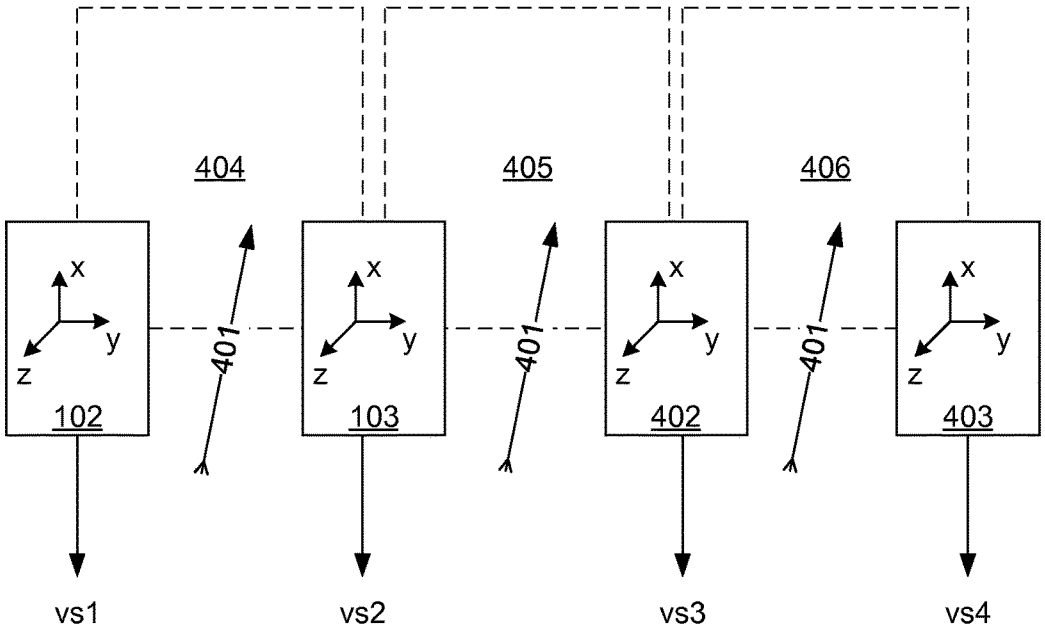
FIG. 4 illustrates a magnetometers associated with a theft-preventing system installed at an array of fitting rooms.

FIG. 4 illustrates magnetometers associated with a theft-preventing system installed at an array of fitting rooms. In general two magnetometers, say magnetometer 101 and 102, installed on opposite sides on a passage to a fitting room 404 or other area provides for the detection described above. However, in some situations there is an array of fitting rooms 404, 405 and 406. To enable detection in each fitting room and thus to identify the fitting room wherein a theft-related event is possibly going on, additional magnetometers 402 and 403 may be installed such they are installed pairwise as a 'gate' across passages 401.

The magnetometers provide respective vector signals vs1, vs2, vs3 and vs4. The vector signals are pairwise processed as described above. Thus each pair of vector signals enables detection of a corresponding movement of the first magnetic field vector and the second magnetic field vector to detect whether a magnet is passing e.g. as indicated respective first alarm control signals, ACS-1. Subsequently, the vector signals are pairwise processed as described above to detect commencement and continuance of fluctuation of at least one of the magnetic field vectors. Thus, an alarm may be raised or enabled to be raised for a specific 'gate' at a corresponding fitting room.

As mentioned above, a magnetometer is installed in a station. The term station generally designates any housing or platform suitable for installing the magnetometers in a shopping area. In case the housing encloses the magnetometer it should not magnetically shield the magnetometer at least on some directions. A suitable cover may be a plastic cover. The magnetometer may be installed on a platform of the station which may be of a magnetically shielding material.

Figure 5:
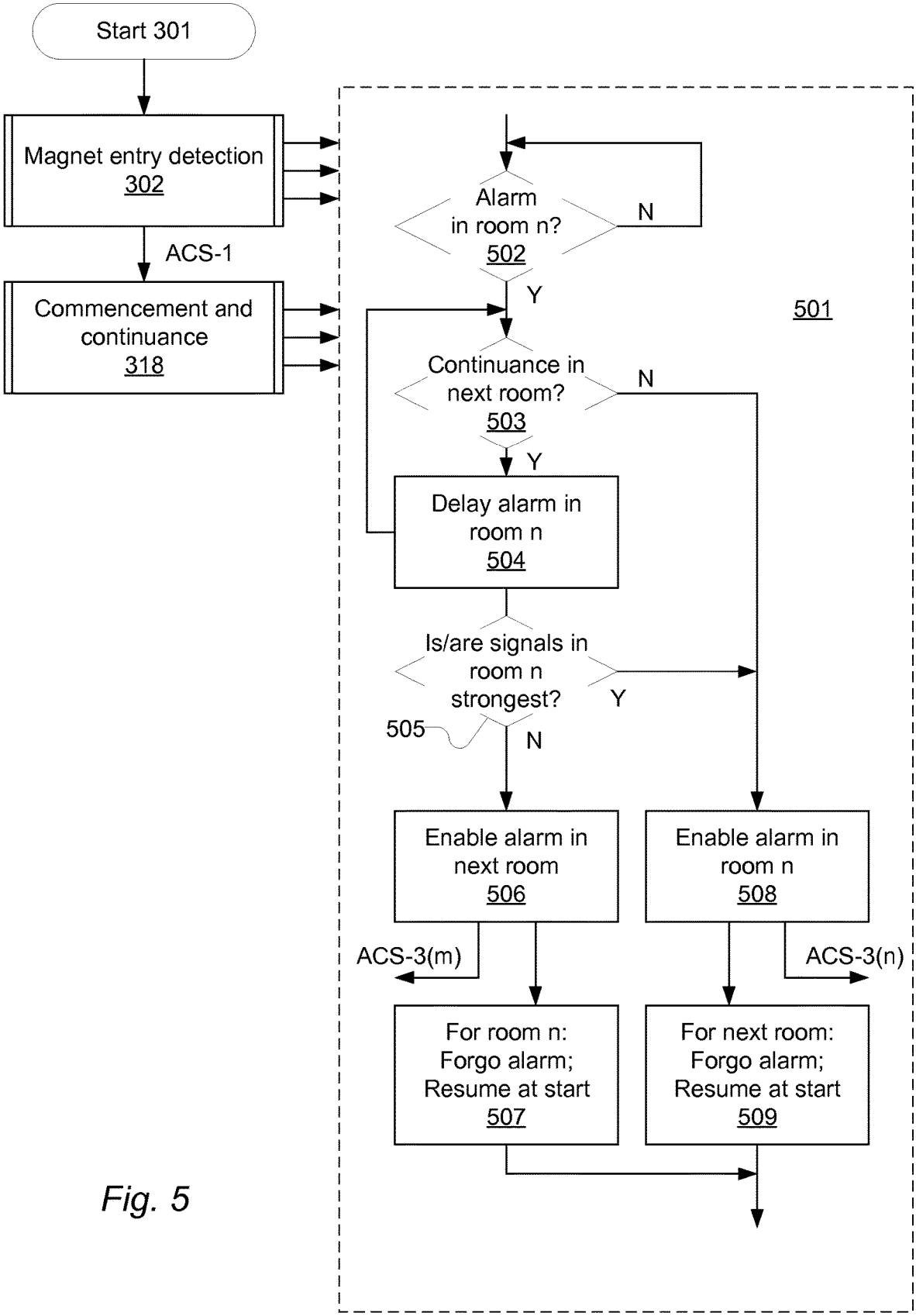
FIG. 5 shows a flowchart for enabling alarms in embodiments at multiple fitting rooms.

FIG. 5 shows a flowchart for enabling alarms in embodiments at multiple fitting rooms. Detection of entry of a detacher magnet through a 'gate' formed by a pair of magnetometers as described above is performed in step 302 and results, in case of a detection, in a first alarm control signal, ACS-1. Also, as described above, commencement and continuance of fluctuations is detected in section 318. This is performed for each of the multiple fitting rooms.

However, to prevent false alarms being raised or enabled to be raised due to magnetic activity being detected from a neighbouring fitting room, the raising or enabling to raise an alarm is subject to further processing as represented by section 501 of the flowchart.

In step 502 it is determined whether an alarm is about to be raised or enabled to be raised for a particular fitting room, n. This may be determined by determining whether the counter, Cntr, associated with the particular fitting room is different from 0; and in the affirmative event thereof determining that an alarm is about to be raised or enabled to be raised for a particular fitting room. Alternatively or additionally this is determined, by determining that processing has reached step 306 as described above for the specific fitting room 'n'.

In case (Y) an alarm is about to be raised or enabled to be raised for the particular fitting room, n, processing continues at step 503 which determines whether continuance of magnetic activity is going on in a neighbouring fitting room (n+1 or n−1). If it is determined that continuance of magnetic activity is going on in a neighbouring fitting room, the raising of the alarm or the enabling of the alarm to be raised is delayed for fitting room, n, in step 504. In some embodiments the delay is about 3 seconds, or more or less. The processing resumes a step 503 to determine whether there is continuance of magnetic activity in a next room as long as continuance of magnetic activity in the next room is detected.

If, instead, it is determined in step 503 that continuance of magnetic activity is not going on (N) in a neighbouring fitting room, the alarm for the fitting room, n, is raised or enabled to be raised in step 508. In some embodiments, the alarm for the fitting room, n, is raised or enabled to be raised in step 508 without further delay. In some embodiments, processing resets the alarm for the neighbouring fitting room, without raising the alarm for the neighbouring fitting room in step 509. Resetting may comprise resuming at start.

If—after lapse of the delay of the alarm in step 504—there is no detection of continuance of magnetic activity (N), processing continues at step 505. At step 505 an estimate of the strength of the magnetic field vector(s) associated with fitting room n and at least one neighbouring fitting room is computed. Then in step 505 it is determined whether the strength of the magnetic field of the magnetic field vector(s) associated with fitting room n is stronger than the strength of the magnetic field of the magnetic field vector(s) associated with a neighbouring fitting room. In the affirmative event thereof, processing continues at steps 508 and 509 as described above, wherein alarm in room n is enabled and wherein processing forgoes enabling alarm for the neighbouring fitting room, since the magnetic activity is more likely associated with fitting room n. In the non-affirmative event thereof, i.e. it is determined based on magnetic strength that a theft-related event is more likely going on in the neighbouring fitting room an alarm is enabled for that fitting room.

Processing forgoes enabling alarm for the fitting room n and resumes at start via step 507.

In some embodiments one or more of steps 506 and 508 outputs a third alarm control signal ACS-3(*m*) or ACS-3(*n*) which enables an alarm to be raised or raises an alarm. Here, parenthesis-m or parenthesis-n indicates that the third alarm control signal is an output associated with a fitting room n or a neighbouring fitting room m. The third alarm control signal is used in case of multiple neighbouring fitting rooms and may replace or supplement the second alarm control signal.

As mentioned above, an alarm emitter may comprise a control unit configured to determine under what conditions to raise an alarm. The control unit may receive multiple alarm control signals which respectively enable an alarm to be raised. The multiple alarm control signals may comprise one or more of the first alarm control signal, the second alarm control signal and the third alarm control signal. The control unit may be separate from the alarm emitter.

In some embodiments a fitting room has multiple neighbours and processing may then determine whether there is magnetic activity in other, additional fitting rooms.

In some fitting room installations, there are a first passage leading to an enclosed or fenced area in which multiple fitting rooms, each with their own passage, are arranged. In some embodiments, magnet entry detection is arranged with a pair of first magnetometers, e.g. multi-axis magnetometers, installed in respective stations on each side of the first passage. Additional, second magnetometers are installed at passages at respective fitting rooms for sensing magnetic activity for the determining of commencement and continuance of magnetic activity. The first magnetometers may be multi-axis magnetometers and the second magnetometers may be simple, single-axis magnetometers. The first magnetometers are installed on each side of the first passage. The second magnetometers are installed e.g. as one or more single-axis magnetometer per fitting room.

The signal processor may be configured as multiple units performing one or more of the processing operations described herein or the signal processor may be configured as one unit, e.g. as a unit accommodating multiple processing modules performing one or more of the processing operations described herein.

Figure 6:
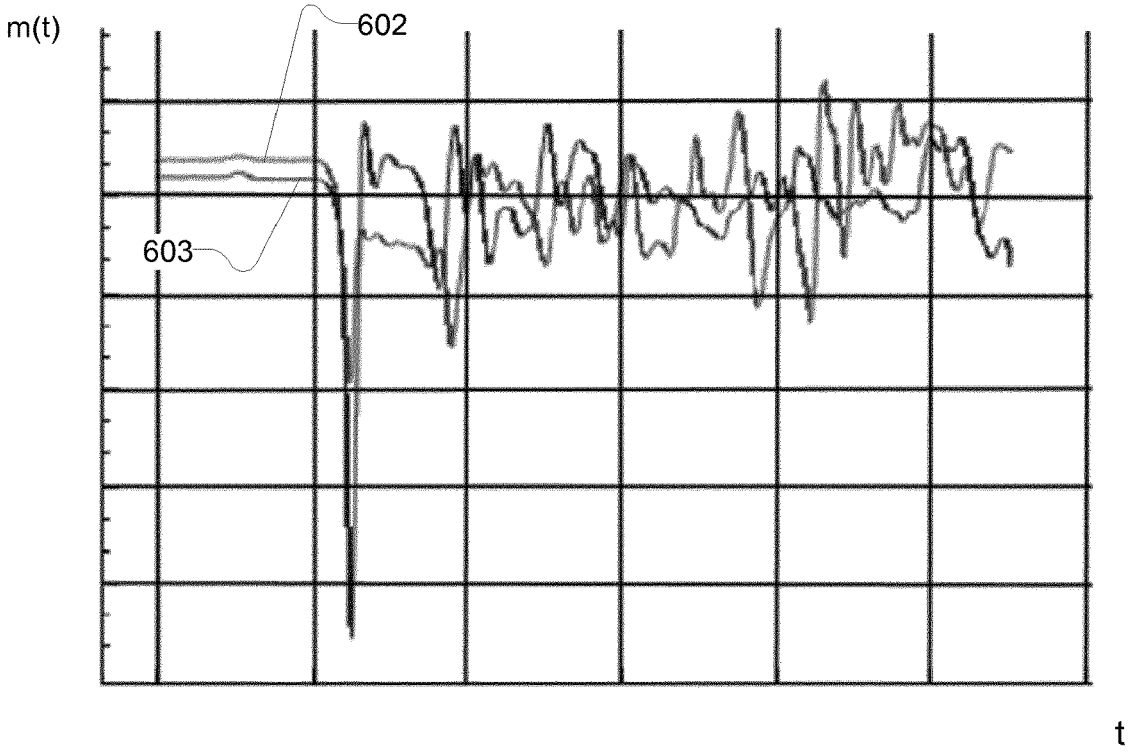
FIG. 6 shows a first vector signal and a second vector signal recorded by respective magnetometers.

FIG. 6 shows a first vector signal and a second vector signal recorded by respective magnetometers. The first vector signal 602 and the second vector signal 603 may be processed to represent a length or strength of a magnetic field vector—e.g. to represent a value at a point in time by a scalar value. It can be seen from FIG. 6 that both the first vector signal 602 and the second vector signal 603 comprises a strong negatively going pulse followed by fluctuations. The fluctuations, or at least the more dominating fluctuations, may be detected as described above by detecting polarity changes in the signals when DC effects are removed or suppressed.

The strong, negatively going pulses correspond to a magnet passing the 'gate' between a pair of magnetometers. However, in many situations, the strength of the pulse is not a sufficient criterion to determine that a magnet is entering. The fluctuations that follow, occur with different strength e.g. due to different distances between the magnet and the magnetometers.

In should be mentioned that fitting rooms may be arranged spatially in various ways with respect to each other. So, installing of magnetometers and deciding which fitting rooms that should be considered to be 'neighbours' depends to the situation at hand. A fitting room may have more than one or more than two neighbours. A fitting room need not have any neighbours if arranged at a distance to other fitting rooms or somehow fully or partially magnetically shielded therefrom.

In should be mentioned that the stations hosting one or more magnetometers and the one or more signal processors, control units and alarm emitters may be coupled by wired or wireless connections to communicate the signals described herein.

There is also provided an electronic theft-prevention system, comprising:

a first multi-axis magnetometer (102) arranged in a first station and configured to output a first vector signal (vs1) representing movement of a first magnetic field vector;

a second multi-axis magnetometer (103) arranged in a second station and configured to output a second vector signal (vs2) representing movement of a second magnetic field vector; and a signal processor (101) coupled to receive the first and second vector signals, and configured to:

at multiple points in time, determining whether movement of the first magnetic field vector and the second magnetic field vector correspond to a substantially horizontal movement of a magnet between the first station and the second station; and in accordance therewith, raising a first alert;

in accordance with a determination that movement of one or both of the first magnetic field vector and the second magnetic field vector corresponds to an oscillating movement of a magnet in proximity of one or both of the first station or in proximity of the second station, raising a second alert;

determining whether to raise or forgo to raise a first alarm that warns about a possible theft-related event in accordance with evaluation of the first alert and the second alert.

Thereby, the first alert may represent that a detacher magnet enters, e.g. by being carried in a bag or in a pocket, between the stations and into a dressing room. The second alert may represent that a detacher magnet is moved e.g. in a repeated way causing a fluctuation predominantly in a vertical plane (about a horizontal axis).

In some aspects the determining whether to raise or forgo to raise a first alarm that warns about a possible theft-related event may be based on the criteria that the second alert occurs at a point in time succeeding a point of time of the first alert. One or both of the first alert and the second alert may be reset in accordance with a timing criterion e.g. that the second alert didn't occur within a time period running from the point of time of the first alert.

The determination whether movement of the first magnetic field vector and the second magnetic field vector predominantly occur as a movement in a vertical plane or as a movement in a horizontal plane, may begin in accordance with a determination that one or more of the magnetic field vectors exceed a criterion e.g. an amplitude criterion i.e. that the vectors exceed a threshold length e.g. over a predetermined period of time.

There is also provided

There is also provided a computer-implemented method for theft-prevention, comprising:

at a signal processor (101) coupled to receive a first vector signal and a second vector signal from a first multi-axis magnetometer (102) arranged in a first station and configured to output the first vector signal (vs1) representing movement of a first magnetic field vector; and a second multi-axis magnetometer (103) arranged in a second station and configured to output a second vector signal (vs2) representing movement of a second magnetic field vector:

at multiple points in time, determining whether movement of the first magnetic field vector and the second magnetic field vector correspond to a substantially horizontal movement of a magnet between the first station and the second station; and in accordance therewith, raising a first alert;

in accordance with a determination that movement of one or both of the first magnetic field vector and the second magnetic field vector corresponds to an oscillating movement of a magnet in proximity of one or both of the first station or in proximity of the second station, raising a second alert; and determining whether to raise or forgo to raise a first alarm that warns about a possible theft-related event in accordance with evaluation of the first alert and the second alert.

Further aspects of the above are set out in the dependent claims, in the summary section and the detailed description.

The invention claimed is:

1. An electronic theft prevention system, comprising:

a first magnetometer arranged in a first station and configured to output a first vector signal (vs1) representing movement of a first magnetic field vector;

a second magnetometer arranged in a second station and configured to output a second vector signal (vs2) representing movement of a second magnetic field vector; and a signal processor coupled to receive the first vector signal and the second vector signal, and configured for:

detecting a corresponding movement of the first magnetic field vector and the second magnetic field vector;

subsequent to the detecting the corresponding movement of the first magnetic field vector and the second magnetic field vector, detecting a pulse in one or both of the first vector signal and the second vector signal and in response thereto increasing a counter and starting a timer; and in response thereto:

determining whether the timer has reached a timeout time; and in the affirmative event thereof, decreasing the counter;

determining whether the counter has reached a counter threshold; and in the affirmative event thereof, enabling an alarm; and determining whether to raise or forgo to raise the alarm that warns about a possible theft-related event.

2. The electronic theft prevention system according to claim 1, wherein the detecting the corresponding movement of the first magnetic field vector and the second magnetic field vector comprises:

determining whether movement of the first magnetic field vector and the second magnetic field vector correspond to a substantially horizontal movement of a magnet between the first station and the second station.

3. The electronic theft prevention system according to claim 1, comprising:

determining whether movement of one or both of the first magnetic field vector and the second magnetic field vector correspond to an oscillating movement of a magnet in proximity of one or both of the first station and the second station.

4. The electronic theft prevention system according to the claim 1, wherein the first magnetometer is configured to measure magnetic field vectors in three dimensions and wherein the signal processor is configured to:

at multiple points in time, determining whether movement of the first magnetic field vector and movement of the second magnetic field vector correspond to a substantially horizontal movement of a magnet between the first station and the second station; and in accordance therewith, raising a first alert;

in accordance with a determination that movement of one or both of the first magnetic field vector and the second magnetic field vector corresponds to an oscillating movement of a magnet in proximity of one or both of the first station and the second station, raising a second alert;

wherein the determining whether to raise or forgo to raise the alarm that warns about a possible theft-related event is in accordance with evaluation of the alert and the second alert.

5. The electronic theft prevention system according to claim 1, wherein the signal processor is further configured to:

determine whether the counter has reached a termination counter value;

terminate the iterative process if the counter has reached the termination counter value; and then reverting to the detecting the corresponding movement of the first magnetic field vector and the second magnetic field vector.

6. The electronic theft prevention system according to claim 1, wherein the signal processor is further configured by an iterative process:

in response to the alarm being raised or enabled, detecting a fluctuation of the first magnetic field vector and starting a second timer;

determining whether the second timer has reached a second timeout time; and in the affirmative event of reaching the second timeout time, resetting the alarm;

in the non-affirmative event of reaching the second timeout time, resetting the second timer.

7. An electronic theft prevention system, comprising:

a first magnetometer arranged in a first station and configured to output a first vector signal (vs1) representing movement of a first magnetic field vector;

a second magnetometer arranged in a second station and configured to output a second vector signal (vs2) representing movement of a second magnetic field vector;

a third magnetometer arranged in a third station and configured to output a third vector signal representing a third magnetic field vector;

a signal processor coupled to receive the first vector signal, the second vector signal, and the third vector signal, and configured for:

detecting a corresponding movement of the first magnetic field vector and the second magnetic field vector;

subsequent to the detecting the corresponding movement of the first magnetic field vector and the second magnetic field vector, detecting commencement and continuance of fluctuation of the first magnetic field vector, wherein continuance of the fluctuation is determined in accordance with a timing criterion;

detecting a corresponding movement of the third magnetic field and the first magnetic field vector;

subsequent to and in the affirmative event of the detecting the corresponding movement of the third magnetic field vector and the first magnet field vector, determining commencement and continuance of fluctuation of the third magnetic field vector; wherein continuance of the fluctuation of the third magnetic field vector is determined subject to a second timing criterion;

determining whether to raise or forgo to raise an alarm that warns about a possible theft-related event in response to at least the determination of commencement and continuance of fluctuation of at least the third magnetic field vector, the first magnetic field vector or the second magnetic field vector.

8. The electronic theft prevention system according to claim 7, wherein the signal processor is further configured to:

in response to determining that one or both of the third and the second magnetic field vector continues to fluctuate after one or both of the first and second magnetic field vectors has ceased to fluctuate, enabling the alarm, while forgo enabling a second alarm;

in response to determining that one or both of the first and the second magnetic field vector continues to fluctuate after one or both of the third and the second magnetic field vectors has ceased to fluctuate, enabling the second alarm, while forgo enabling the alarm.

9. The electronic theft prevention system according to claim 7, wherein the signal processor is further configured to:

in response to determining that one or both of the third and the second magnetic field vector is stronger than one or both of the first and second magnetic field vectors, enabling the alarm, while forgo enabling a second alarm;

in response to determining that one or both of the first and the second magnetic field vector is stronger than one or both of the third and the second magnetic field vectors, enabling the second alarm, while forgo enabling the alarm.

10. The electronic theft prevention system according to claim 1, wherein the signal processor is further configured to:

perform the detecting the corresponding movement of the first magnetic field vector and the second magnetic field vector by:

estimating a first rotation of the first magnetic field vector and a second rotation of the second magnetic field vector;

generating an indicator signal comprising indication of a counter-direction rotation of the first magnetic field vector and the second magnetic field vector or a same-direction rotation of the first magnetic field vector and the second magnetic field vector;

determining whether to enable the alarm in response to at least the indicator signal.

11. An electronic theft prevention system, comprising:

a first magnetometer arranged in a first station and configured to output a first vector signal (vs1) representing movement of a first magnetic field vector;

a second magnetometer arranged in a second station and configured to output a second vector signal (vs2) representing movement of a second magnetic field vector wherein the first station and the second station are installed 0.5 to 1.5 meters above a floor level; and a signal processor coupled to receive the first vector signal and the second vector signal, and configured for:

detecting a corresponding movement of the first magnetic field vector and the second magnetic field vector;

subsequent to the detecting the corresponding movement of the first magnetic field vector and the second magnetic field vector, detecting commencement and continuance of fluctuation of the first magnetic field vector, wherein continuance of the fluctuation is determined in accordance with a timing criterion; and determining whether to raise or forgo to raise the alarm that warns about a possible theft-related event in response to at least the determining of commencement and continuance of fluctuation of the first magnetic field vector.

12. A method of detecting a theft-related event, comprising:

acquiring first vector values representing movement of a first magnetic field vector by a first multi-axis magnetometer arranged in a first station;

acquiring second vector values representing movement of a second magnetic field vector by a second multi-axis magnetometer arranged in a second station;

detecting a corresponding movement of the first magnetic field vector and the second magnetic field vector;

subsequent to and in the affirmative event of the detecting the corresponding movement of the first magnetic field vector and the second magnetic field vector, detecting a pulse in one or both of the first vector signal and the second vector signal and in response thereto increasing a counter and starting a timer; and in response thereto:

determining whether the timer has reached a timeout time; and in the affirmative event thereof, decreasing the counter;

determining whether the counter has reached a counter threshold; and in the affirmative event thereof, enabling an alarm; and determining whether to raise or forgo to raise the alarm that warns about a possible theft-related event.

13. A data processing system comprising:

a processor;

a first multi-axis magnetometer arranged in a first station and in communication with the processor;

a second multi-axis magnetometer arranged in a second station and in communication with the processor;

a memory in communication with the processor, wherein the memory has stored therein a computer readable code that when executed by the processor the following method is performed:

acquiring first vector values representing movement of a first magnetic field vector by the first multi-axis magnetometer;

acquiring second vector values representing movement of a second magnetic field vector by the second multi-axis magnetometer;

detecting a corresponding movement of the first magnetic field vector and the second magnetic field vector;

subsequent to and in the affirmative event of the detecting the corresponding movement of the first magnetic field vector and the second magnetic field vector, detecting a pulse in one or both of the first vector signal and the second vector signal and in response thereto increasing a counter and starting a timer; and in response thereto:

determining whether the timer has reached a timeout time; and in the affirmative event thereof, decreasing the counter;

determining whether the counter has reached a counter threshold; and in the affirmative event thereof, enabling an alarm; and determining whether to raise or forgo to raise an alarm that warns about a possible theft-related event.

14. A non-transitory computer medium comprising program code adapted to cause a data processing system to perform the method of:

acquiring first vector values representing movement of a first magnetic field vector by a first multi-axis magnetometer arranged in a first station;

acquiring second vector values representing movement of a second magnetic field vector by a second multi-axis magnetometer arranged in a second station;

detecting a corresponding movement of the first magnetic field vector and the second magnetic field vector;

subsequent to and in the affirmative event of the detecting the corresponding movement of the first magnetic field vector and the second magnetic field vector, detecting a pulse in one or both of the first vector signal and the second vector signal and in response thereto increasing a counter and starting a timer; and in response thereto:

determining whether the timer has reached a timeout time; and in the affirmative event thereof, decreasing the counter;

determining whether the counter has reached a counter threshold; and in the affirmative event thereof, enabling an alarm; and determining whether to raise or forgo to raise an alarm that warns about a possible theft-related event.

15. The electronic theft prevention system according to claim 7, further comprising detecting a corresponding movement of the third magnetic field vector and the second magnetic field vector.

16. The electronic theft prevention system according to claim 1, wherein the first station and the second station are installed 0.5 to 1.5 meters above a floor level.

17. The electronic theft prevention system according to claim 1, comprising:

a third magnetometer arranged in a third station and configured to output a third vector signal representing a third magnetic field vector; and wherein the signal processor is coupled to receive the third vector signal, and configured to:

detect a corresponding movement of the third magnetic field and the first magnetic field vector;

subsequent to and in the affirmative event of the detecting the corresponding movement of the third magnetic field vector and the first magnet field vector, determining commencement and continuance of fluctuation of the third magnetic field vector; wherein continuance of the fluctuation of the third magnetic field vector is determined subject to a second timing criterion;

determining whether to raise or forgo to raise a second alarm that warns about a possible theft-related event in response to at least the determination of commencement and continuance of fluctuation of at least the third magnetic field vector, the first magnetic field vector or the second magnetic field vector.

* * * * *